US011441417B2

(12) United States Patent
Ward et al.

(10) Patent No.: US 11,441,417 B2
(45) Date of Patent: Sep. 13, 2022

(54) MOTOR FOR HORIZONTAL DIRECTIONAL DRILLING SYSTEMS

(71) Applicant: Quality Drilling Technology, LLC, Cypress, TX (US)

(72) Inventors: James Ward, Baytown, TX (US); Shu Wang, Cypress, TX (US); Li Li, Richmond, TX (US); Clemente Lopez Arias, Baytown, TX (US); Yan Wang, Cypress, TX (US); Robert Folkins, Spring, TX (US)

(73) Assignees: Quality Drilling Technology, LLC, Cypress, TX (US); Horizontal Drilling Technologies Inc., Hockley, TX (US)

( * ) Notice: Subject to any disclaimer, the term of this patent is extended or adjusted under 35 U.S.C. 154(b) by 0 days.

(21) Appl. No.: 17/171,181

(22) Filed: Feb. 9, 2021

(65) Prior Publication Data

US 2022/0251941 A1 Aug. 11, 2022

(51) Int. Cl.

| | |
|---|---|
| ***E21B 47/09*** | (2012.01) |
| ***E21B 4/00*** | (2006.01) |
| ***E21B 7/04*** | (2006.01) |

(52) U.S. Cl.
CPC ..... *E21B 47/09* (2013.01); *E21B 4/003* (2013.01); *E21B 7/046* (2013.01)

(58) Field of Classification Search
CPC ..... E21B 47/09; E21B 4/003; E21B 7/046
See application file for complete search history.

(56) References Cited

U.S. PATENT DOCUMENTS

| | | | | |
|---|---|---|---|---|
| 6,749,030 | B2 * | 6/2004 | Blair | E21B 47/017 73/152.43 |
| 7,036,609 | B2 * | 5/2006 | Michael | E21B 47/017 175/398 |
| 7,182,154 | B2 * | 2/2007 | Harrison | E21B 47/024 175/45 |

* cited by examiner

*Primary Examiner* — Jonathan Malikasim
(74) *Attorney, Agent, or Firm* — Benjamin Aaron Adler

(57) ABSTRACT

Provided herein is a motor or mud lubricated motor for use with horizontal directional drilling equipment as part of a trenchless drilling system. The motor has a hollow body with proximal and distal open ends and a compartment recessed into a top surface thereof between the proximal open end and the distal open end. A sonde housing with a removable cap secured to the housing is disposed within the compartment and contains a sonde transmitter and a battery operably connected to the sonde transmitter.

14 Claims, 7 Drawing Sheets

MOTOR FOR HORIZONTAL DIRECTIONAL DRILLING SYSTEMS

BACKGROUND OF THE INVENTION

Field of the Invention

The present invention is in the field of horizontal directional drilling. More specifically, the present invention is directed to an improved sonde motor for use in trenchless horizontal directional drilling equipment.

Description of the Related Art

Horizontal Directional Drilling (HDD) is a method used for installing underground pipelines, cables and service conduits. It uses a directional trenchless equipment powered by a combination HDD motor and sonde that enables accurate drilling along the desired path from the starting entry point to the exit point.

Sonde motors presently used comprise a sonde transmitter that is located far away from the drill bit, which prevents accurate steering during drilling. Secondly, the sonde transmitter housing in commercial motors is not customizable to fit any transmitter. As a result, users are forced to compromise on the choice of transmitters for their needs. Thirdly, sonde transmitter housings require a cap that is easily installable and permits easy access to the transmitter without allowing entry of mud and rocks into the housing during drilling, features that are not available in commercial sonde motors.

Thus, there is a deficiency in the art for customizable horizontal directional drilling sonde motors having precise drill maneuverability during operation. The present invention fulfills this longstanding need and desire in the art.

SUMMARY OF THE INVENTION

The present invention is directed to a motor for horizontal directional drilling. The motor has a hollow, substantially cylindrical body with a proximal open end, a distal open end and a sonde housing formed longitudinally along on a top surface. A shaft with a proximal end and a distal end is disposed along a longitudinal axis within the body. A lower mandrel comprises a distal end disposed within the substantially cylindrical body and a proximal end and an upper mandrel comprising a proximal end disposed within the substantially cylindrical body and attached to the distal end of the shaft. A sonde transmitter is secured within the sonde housing and a battery is disposed within the sonde housing and operably connected to the sonde transmitter.

The present invention also is directed to a trenchless drilling system. The trenchless drilling system comprises a mud lubricated motor that has a hollow body with a proximal open end, a distal open end and a compartment recessed into a top surface thereof between the proximal open end and the distal open end. A sonde housing, with a sonde housing cap removably secured thereto, is disposed within the compartment and contains a sonde transmitter secured therewithin and a battery operably connected to the sonde transmitter.

Other and further aspects, features, benefits, and advantages of the present invention will be apparent from the following description of the presently preferred embodiments of the invention given for the purpose of disclosure.

DETAILED DESCRIPTION OF THE PRESENT INVENTION

Figure 1A:
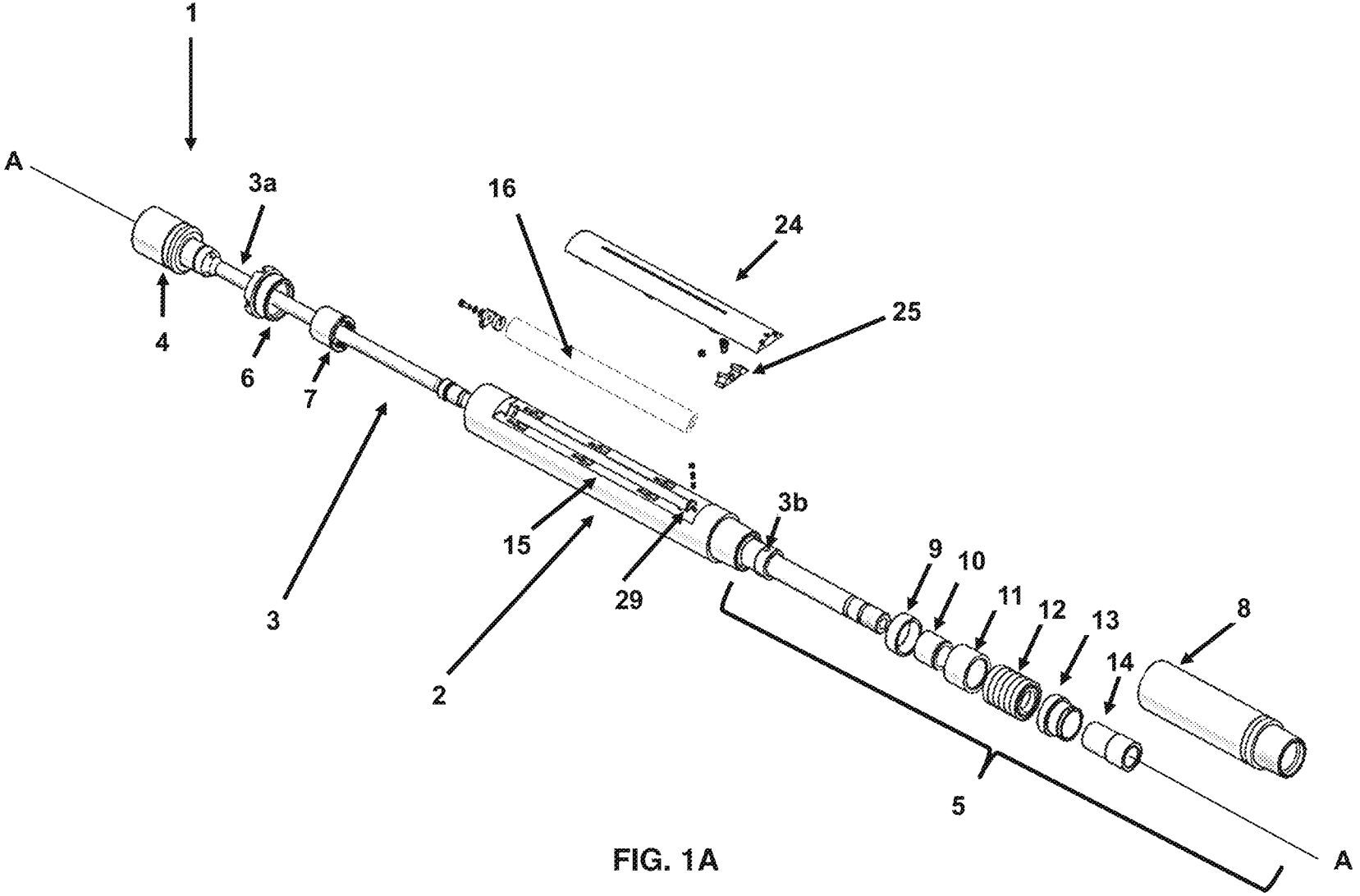
FIG. 1A is an exploded view of the sonde motor.

As used herein, the term "a" or "an" when used in conjunction with the term "comprising" in the claims and/or the specification may mean "one," but it is also consistent with the meaning of "one or more," "at least one," and "one or more than one." Some embodiments of the invention may consist of or consist essentially of one or more elements, method steps, and/or methods of the invention. It is contemplated that any method described herein can be implemented with respect to any other method described herein.

As used herein, the term "or" in the claims is used to mean "and/or" unless explicitly indicated to refer to alternatives only or the alternatives are mutually exclusive, although the disclosure supports a definition that refers to only alternatives and "and/or."

As used herein, "comprise" and its variations, such as "comprises" and "comprising," will be understood to imply the inclusion of a stated item, element or step or group of items, elements or steps but not the exclusion of any other item, element or step or group of items, elements or steps unless the context requires otherwise. Similarly, "another" or "other" may mean at least a second or more of the same or different claim element or components thereof.

The term "including" is used herein to mean "including, but not limited to". "Including" and "including, but not limited to" are used interchangeably.

As used herein, the term "about" refers to a numeric value, including, for example, whole numbers, fractions, and percentages, whether or not explicitly indicated. The term "about" generally refers to a range of numerical values (e.g., ±5-10% of the recited value) that one of ordinary skill in the art would consider equivalent to the recited value (e.g., having the same function or result). In some instances, the term "about" may include numerical values that are rounded to the nearest significant figure. For example, a length for a sonde transmitter with a length of about 24 in. encompasses a length of 21.6 in. to 26.4 in.

As used herein, the terms "proximal" and "distal" in reference to the motor disclosed herein refers to those components, features, parts, and elements of or within the motor nearest to and farthest from the drill bit, respectively.

As used herein, the terms "lower mandrel" and "upper mandrel" refer to a mandrel as is known in the art located, respectively, at the proximal end and at the distal end of the motor.

As used herein, the terms motor and mud lubricated motor are used interchangeably.

In one embodiment of the present invention there is provided a motor for horizontal directional drilling comprising a hollow, substantially cylindrical body with a proximal open end, a distal open end and a sonde housing formed longitudinally along a top surface thereof; a shaft with a proximal end and a distal end disposed along a longitudinal axis within the body; a lower mandrel comprising a distal end disposed within the substantially cylindrical body and a proximal end; an upper mandrel comprising a proximal end disposed within the substantially cylindrical body and attached to the distal end of the shaft; a sonde transmitter secured within the sonde housing; and a battery disposed within the sonde housing and operably connected to the sonde transmitter.

In this embodiment the motor may be a mud lubricated bearing assembly motor. Also the lower mandrel may comprise a drill bit operably attached at the proximal end thereof. In addition the upper mandrel may comprise a spacer disposed proximate to the distal end of the shaft and an upper mandrel housing circumferentially disposed on the shaft and secured thereon, where the upper mandrel housing is configured to house a means for attaching the upper mandrel to the shaft.

In this embodiment the sonde housing may be disposed between the distal end of the lower mandrel and the proximal end of the upper mandrel. Also, the sonde housing may have an outer diameter and an inner diameter that is eccentric with respect to the outer diameter along the longitudinal axis. In addition, the sonde housing may comprise a cap removably secured thereto. Particularly, the cap may be removably secured via a spring-loaded mechanism or via a cap lock plate or a combination thereof.

In this embodiment the sonde transmitter may secured within the sonde housing about 11" to about 12" from a proximal end of the lower mandrel. Also, the sonde transmitter may have an outer diameter of about 0.5 inches to about 1.5 inches. In addition the sonde transmitter may have a length of about 3 inches to about 24 inches.

In another embodiment of the present invention there is provided a trenchless drilling system comprising a mud lubricated motor comprising a hollow body with a proximal open end, a distal open end and a compartment recessed into a top surface thereof between the proximal open end and the distal open end; and a sonde housing, with a sonde housing cap removably secured thereto, disposed within the compartment and containing a sonde transmitter secured therewithin and a battery operably connected to the sonde transmitter.

In one aspect of this embodiment the mud lubricated motor comprises a lower mandrel comprising a distal end disposed within the hollow body and a proximal end; a drill bit attached to the proximal end of the lower mandrel; a shaft with a proximal end attached to the distal end of the lower mandrel and a distal end disposed along a longitudinal axis within the hollow body; and an upper mandrel comprising a proximal end disposed within the hollow body and attached to the distal end of the shaft. In this aspect the lower mandrel may comprise an attachment means for attachment to the shaft. In another aspect of this embodiment the upper mandrel comprises a spacer disposed proximate to the distal end of the shaft; and an upper mandrel housing circumferentially disposed on the shaft and secured thereon, where the upper mandrel housing is configured to house a means for attaching the upper mandrel to the shaft.

In this embodiment and both aspects thereof the sonde housing cap may be removably secured via a spring-loaded mechanism or via a cap lock plate or a combination thereof. Also, the sonde housing may be disposed between the distal end of the lower mandrel and the proximal end of the upper mandrel and has an inner diameter that is eccentric with respect to the outer diameter along the longitudinal axis. In addition, the sonde transmitter may be secured within the sonde housing about 11 inches to about 12 inches from a proximal end of the lower mandrel. Furthermore, the sonde transmitter may have an outer diameter of about 0.5 inches to about 1.5 inches. Further still the sonde transmitter may have a length of about 3 inches to about 24 inches.

Provided herein is a motor for horizontal directional drilling which has a compartment or recess that contains a sonde housing. A suitable motor may be, but is not limited to, a sonde mud motor or a mud lubricated motor including, for example, a mud lubricated bearing assembly motor, which is modified with the sonde housing compartment or recess on the top surface thereof.

The components of the motor are, inter alia, a shaft longitudinally disposed within the motor body, a lower mandrel, which comprises the drill bit, attached to the proximal end of the shaft and an upper mandrel attached to the distal end of the shaft. The lower mandrel is attached to the shaft using any suitable attachment means including, but not limited to, a lower inner radial and an end nut. The upper mandrel comprises an upper mandrel housing disposed around the shaft and comprises a means for attaching to the shaft. Any commercially available attachment means may be used including, but not limited to, a middle inner radial, a middle outer radial, a thrust bearing race pack, an upper outer radial and an upper inner radial.

The sonde housing contains a sonde transmitter and a power source for the transmitter and has a removable cap that shields the transmitter and the power source from the elements and the surrounding environment during digging. The cap may have a spring-loaded means to removably secure the cap to the housing. The cap also may have a removable cap lock plate for additional securement to the housing.

The sonde transmitter is operably connected to a power source, such as, but not limited to, at least one battery, contained within the sonde housing. The sonde housing is disposed within the compartment between the lower mandrel and the upper mandrel. The battery is disposed within the sonde housing either proximate to the lower mandrel or proximate to the upper mandrel in a battery up or a battery down position. The sonde housing also may comprise a spacer that is disposed circumferentially and proximate to the distal end of the shaft. The rubber spacer has a length sufficient to accommodate a sonde transmitter of any length within the sonde housing. The rubber spacer may be cut or adjusted to the necessary length to fill the spacing gap within the sonde housing once the transmitter is installed.

Particularly, embodiments of the present invention are better illustrated with reference to the Figure(s), however, such reference is not meant to limit the present invention in any fashion. The embodiments and variations described in detail herein are to be interpreted by the appended claims and equivalents thereof.

FIG. 1A is an exploded view of a sonde motor 1 showing the hollow, cylindrical body 2, a shaft 3, attached at a proximal end 3*a* to a lower mandrel 4 and at a distal end 3*b* to an upper mandrel 5. The lower mandrel is secured to the shaft with an end nut 6. A lower inner radial 7 enables rotation of the lower mandrel around the longitudinal axis A-A of the shaft. The upper mandrel comprises an upper mandrel housing 8 that is axially disposed around the shaft and secured thereon. Within the housing is encompassed, a spacer 9 disposed circumferentially and proximate to the distal end of the shaft, a middle inner radial 10 disposed proximate to the spacer, a middle outer radial 11 disposed proximate to the middle inner radial, a thrust bearing race pack 12 disposed proximate to the middle outer radial, an upper outer radial 13 and an upper inner radial 14 that together enable smooth axial rotation of the shaft and the lower mandrel, propelled by pumping of mud into the upper mandrel housing. A sonde housing compartment 15 is formed on a top surface of the hollow, cylindrical body 2, that houses a sonde transmitter 16. A sonde housing cap 24 shields and protects the transmitter from the elements as the motor is in operation underground. The cap is removably secured to the sonde housing with a cap lock plate 25.

Figure 1B:
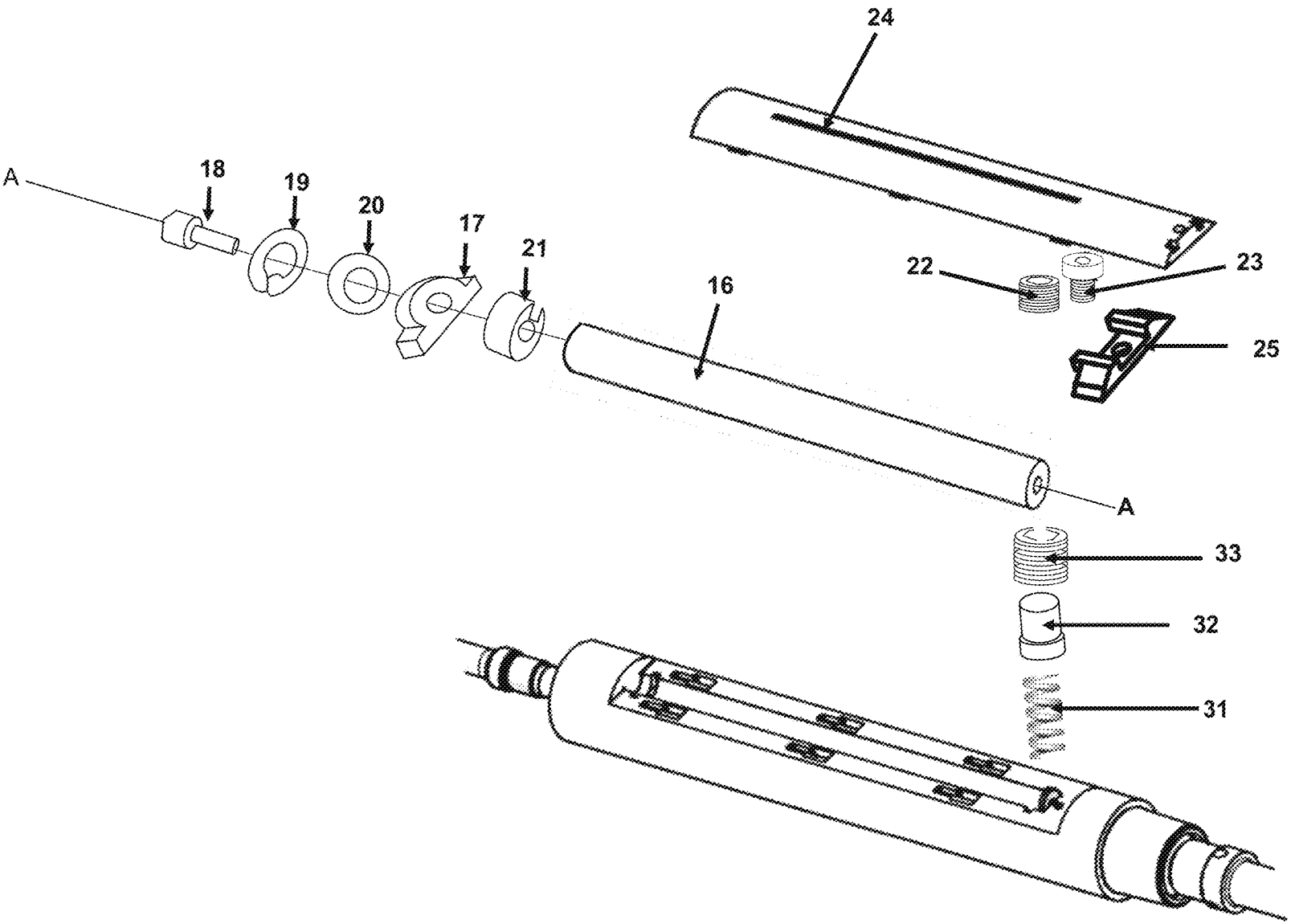
FIG. 1B is a magnified view of the sonde housing and sonde transmitter in FIG. 1A showing the means for securing the proximal end of the sonde transmitter within the sonde housing.

With continued reference to FIG. 1A, FIG. 1B is a magnified view showing the sonde transmitter secured at its proximal end 16*a* to the sonde housing with a sonde holding plate 17, a hex bolt 18, a helical spring washer 19 and a circular washer 20. A sonde orienting key 21 disposed between the proximal end of the sonde transmitter and the sonde holding plate enables the user to rotate and orient the transmitter with the housing. A rubber spacer 29 is disposed between the distal end of the transmitter and the attachment means. The rubber spacer allows a user to use a sonde transmitter having any length and is cut to the necessary length to make up the spacing gap within the sonde housing once the transmitter is installed. The sonde housing cap 24, removably secured to the sonde housing with a cap lock plate 25 with attachment means comprising a set screw 22 and a socket head screw 23, a spring 31, a spring load pin 32 and a spring-loaded threaded cap 33. The sonde housing cap shields and protects the transmitter from the elements as the motor is in operation underground.

Figure 2:
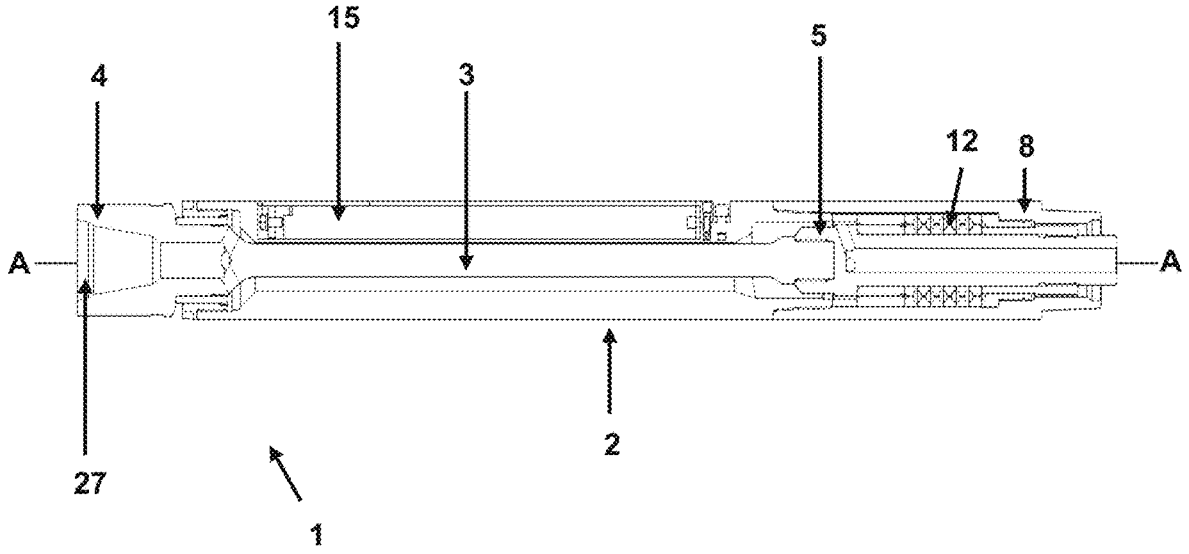
FIG. 2 is a cross-sectional view of the sonde housing shown in FIG. 1A.

With continued reference to FIGS. 1A-1B, FIG. 2 is a longitudinal cross-sectional view of the sonde motor 1 comprising the hollow, cylindrical body 2 and a lower mandrel 4 to which is attached a drill bit 27. The lower mandrel is attached to the proximal end of the shaft 3. An upper mandrel 5, comprising an upper mandrel housing 8 and thrust bearing race pack 12 is attached at the distal end of the shaft. The sonde housing compartment 15 is formed on the top surface of the hollow, cylindrical body.

Figure 3A:
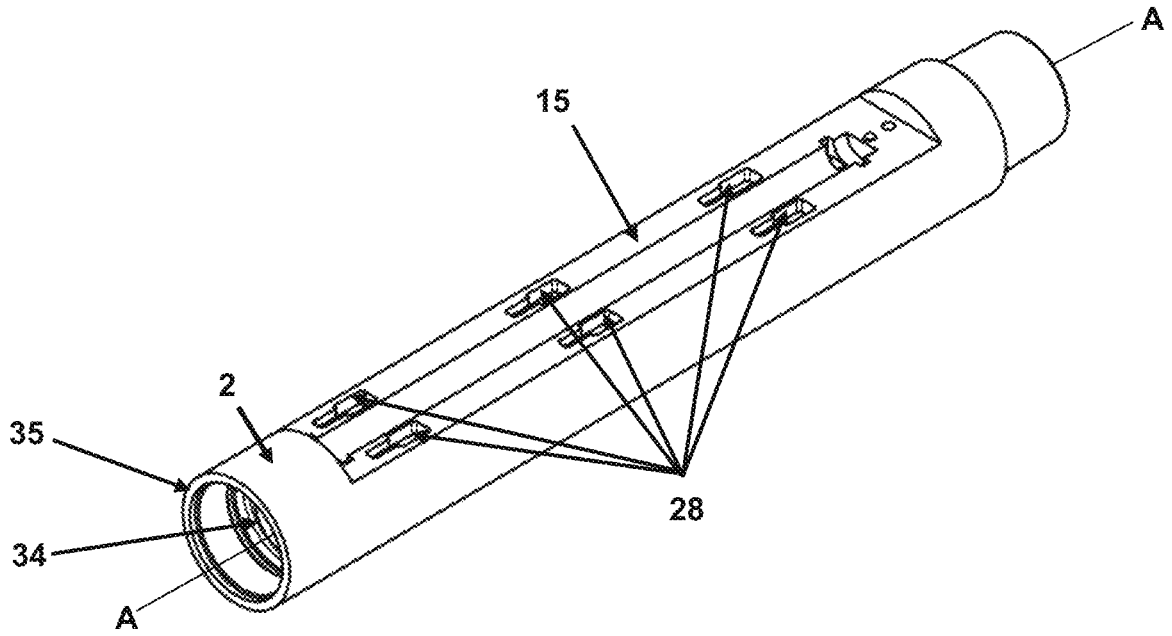
FIG. 3A is a perspective view of the sonde housing showing the open proximal end and the T-slot locks.

With continued reference to FIGS. 1A-1B, FIG. 3A is a magnified view showing the hollow cylindrical body 2 on a top surface of which is formed the sonde housing compartment 15. The sonde housing compartment is provided with female "T" slot locks represented by 28 that enables the cap to be removable locked to the housing via the spring-loaded pin. The sonde housing has an inner diameter 34 and outer diameter 35 of the sonde housing where the inner diameter is machined eccentrically from the outer diameter other along the longitudinal axis A-A (see FIG. 3B).

Figure 3B:
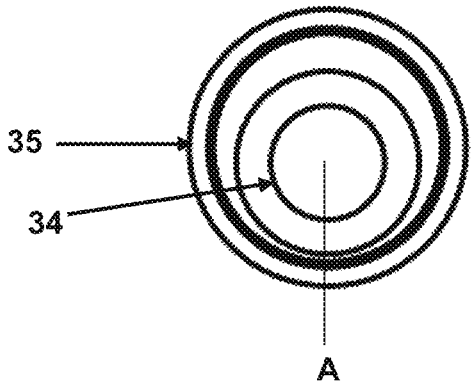
FIG. 3B illustrates the eccentricity of the inner diameter of the open proximal end of the sonde housing in FIG. 3A.
Figure 4A:
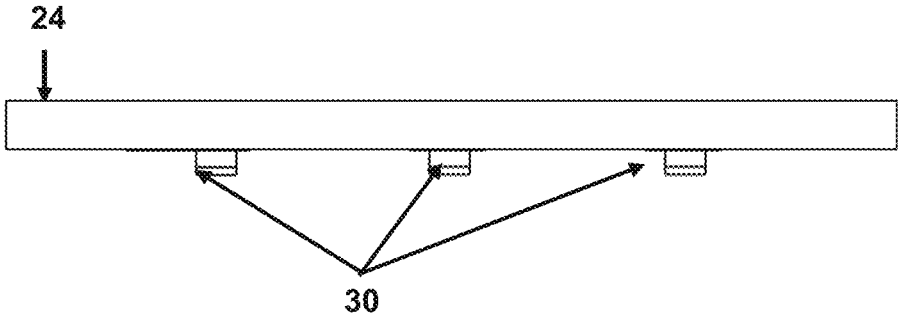
FIGS. 4A-4B illustrate how the male components of the T-slot locks are disposed on the sonde housing cap.
Figure 4B:
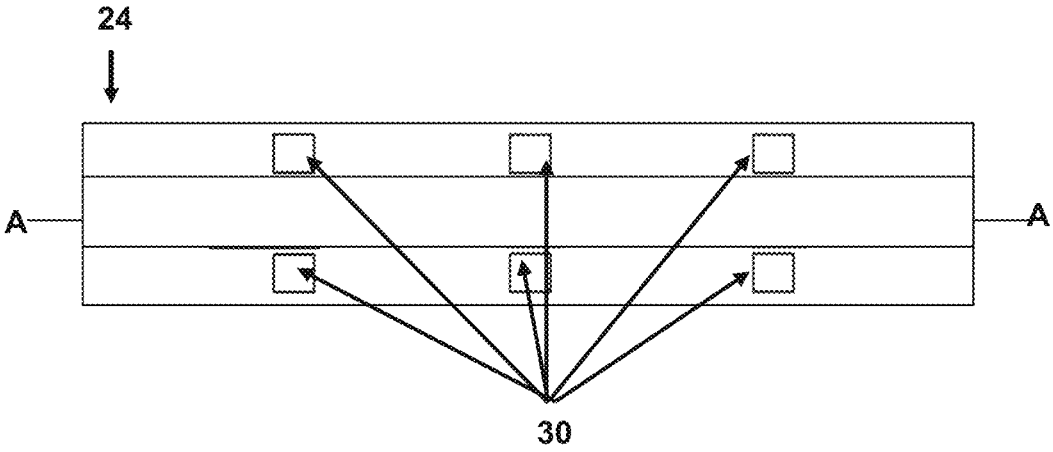

With continued reference to FIG. 3A, FIG. 3B is the open proximal end of the sonde housing illustrating the eccentricity of the inner diameter 34 with respect to the outer diameter 35 around the longitudinal axis A-A. This feature enables use with a variety of sonde transmitter sizes.

With continued reference to FIGS. 1A-1B and 3A, FIGS. 4A and 4B illustrate in magnified views the placement on the sonde housing cap 24 of the complementary male T-slot locks, for example, but not limited to dovetail style slot lock represented by 30 that engage with the female T-slot locks.

Figure 5A:
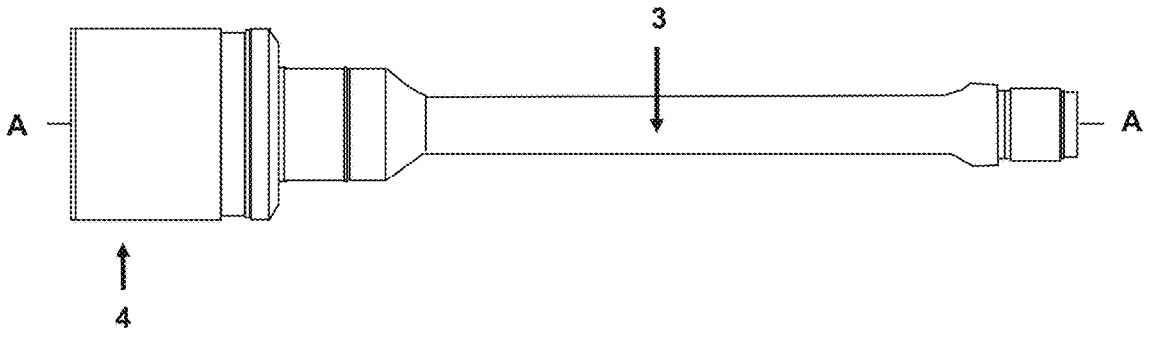
FIG. 5A is a magnified view of the lower mandrel attached to the shaft in the motor.

With continued reference to FIGS. 1A-1B, FIG. 5A is a magnified view of the lower mandrel 4 attached at its distal end to the shaft 3.

Figure 5B:
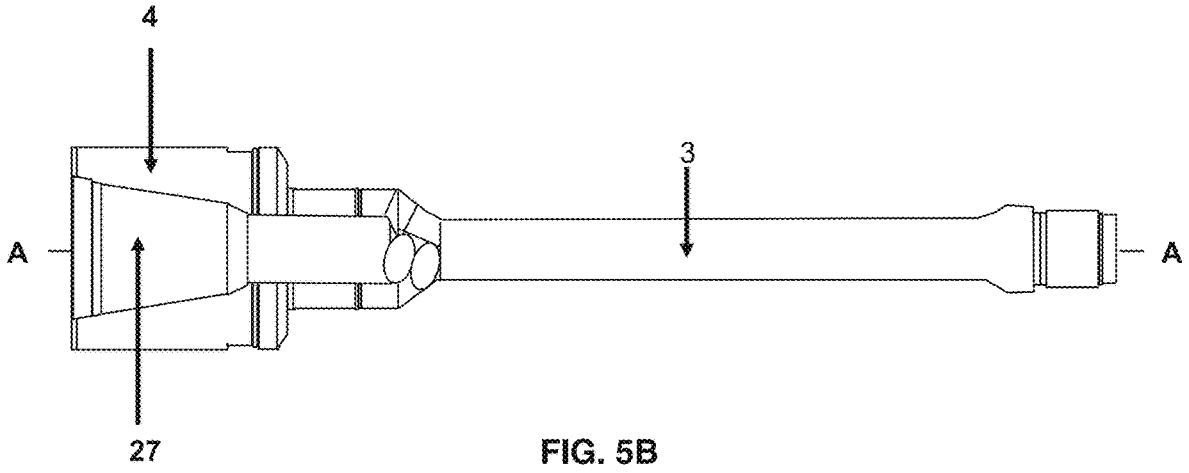
FIG. 5B is a cross-sectional view of FIG. 5A showing the placement of the drill bit within the lower mandrel.

With continued reference to FIG. 5A, FIG. 5B is a longitudinal cross-section of the lower mandrel with the drill bit 27 attached therewithin.

Figure 6A:
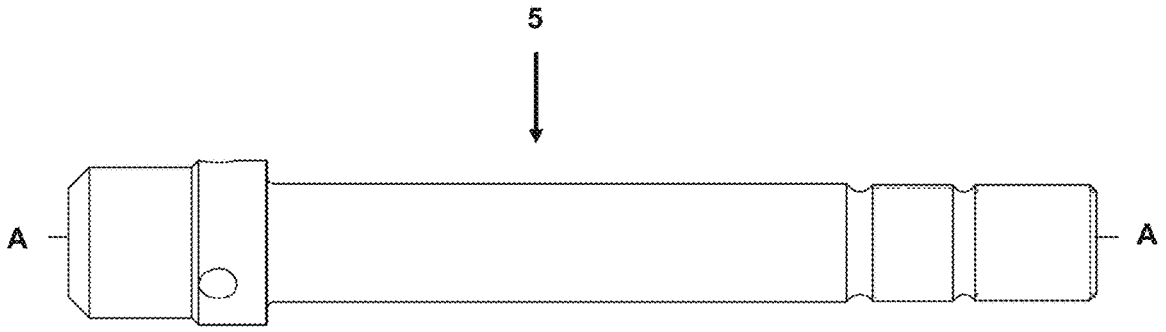
FIG. 6A is a magnified view of the upper mandrel attached to the shaft in the motor.

With continued reference to FIGS. 1A-1B, FIG. 6A is a magnified view of the upper mandrel 5.

Figure 6B:
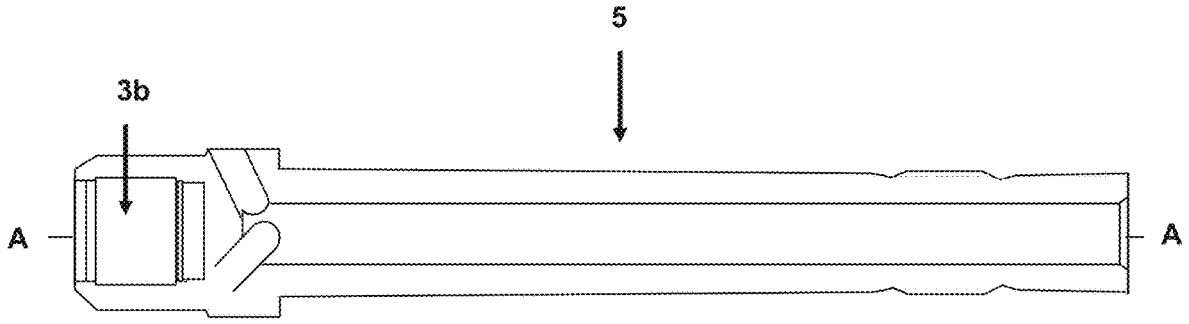
FIG. 6B is a cross-sectional view of FIG. 6A showing the attachment of the lower mandrel to the shaft.

With continued reference to FIGS. 1A and 6A, FIG. 6B is a longitudinal cross-section of the upper mandrel showing the attachment at its proximal end to the distal end 3*b* of the shaft.

What is claimed is:

1. A motor for horizontal directional drilling comprising:
- a sonde housing with a hollow, substantially cylindrical body with a proximal open end, a distal open end and a longitudinal axis therethrough and having an outer diameter and an inner diameter that is eccentric with respect to the outer diameter along the longitudinal axis, said sonde housing comprising:
  - a sonde housing compartment formed longitudinally along a top surface thereof; and
  - a cap removably secured thereto via a spring-loaded mechanism or via a cap lock plate or via a combination thereof;
- a shaft with a proximal end and a distal end disposed along the longitudinal axis within the sonde housing;
- a lower mandrel comprising a distal end disposed within the sonde housing and a proximal end;
- an upper mandrel comprising a proximal end disposed within the sonde housing and attached to the distal end of the shaft;
- a sonde transmitter secured within the sonde housing compartment; and
- a battery disposed within the sonde housing and operably connected to the sonde transmitter.

2. The motor of claim 1, wherein the motor is a mud lubricated bearing assembly motor.

3. The motor of claim 1, wherein the lower mandrel comprises a drill bit operably attached at the proximal end thereof.

4. The motor of claim 1, wherein the upper mandrel comprises:
- a spacer disposed proximate to the distal end of the shaft; and
- an upper mandrel housing circumferentially disposed on the shaft and secured thereon, said upper mandrel housing configured to house a means for attaching the upper mandrel to the shaft.

5. The motor of claim 1, wherein the sonde housing is disposed between the distal end of the lower mandrel and the proximal end of the upper mandrel.

6. The motor of claim 1, wherein the sonde transmitter is secured within the sonde housing about 11 inches to about 12 inches from the proximal end of the lower mandrel.

7. The motor of claim 1, wherein the sonde transmitter has an outer diameter of about 0.5 inches to about 1.5 inches.

8. The motor of claim 1, wherein the sonde transmitter has a length of about 3 inches to about 24 inches.

9. A trenchless drilling system comprising:
- a mud lubricated motor comprising:
  - a hollow body with a proximal open end, a distal open end, and a longitudinal axis therethrough and having an outer diameter and an inner diameter that is eccentric with respect to the outer diameter along the longitudinal axis; said hollow body comprising a sonde housing compartment recessed into a top surface thereof between the proximal open end and the distal open end;

a lower mandrel comprising a distal end disposed within the hollow body and a proximal end;

a drill bit attached to the proximal end of the lower mandrel;

a shaft with a proximal end attached to the distal end of the lower mandrel and a distal end disposed along the longitudinal axis within the hollow body;

an upper mandrel comprising a proximal end disposed within the hollow body and attached to the distal end of the shaft;

a sonde housing cap removably secured to the sonde housing compartment via a spring-loaded mechanism or via a cap lock plate or via a combination thereof; and a sonde transmitter that is operably connected to a battery and is secured within the sonde housing compartment.

10. The trenchless drilling system of claim 9, wherein the lower mandrel comprises an attachment means for attachment to the shaft.

11. The trenchless drilling system of claim 9, wherein the upper mandrel comprises:

a spacer disposed proximate to the distal end of the shaft; and an upper mandrel housing circumferentially disposed on the shaft and secured thereon, said upper mandrel housing configured to house a means for attaching the upper mandrel to the shaft.

12. The trenchless drilling system of claim 9, wherein the sonde transmitter is secured within the sonde housing compartment about 11 inches to about 12 inches from the proximal end of the lower mandrel.

13. The trenchless drilling system of claim 9, wherein the sonde transmitter has an outer diameter of about 0.5 inches to about 1.5 inches.

14. The trenchless drilling system of claim 9, wherein the sonde transmitter has a length of about 3 inches to about 24 inches.

* * * * *